US011047544B2

(12) United States Patent
Zozgornik

(10) Patent No.: US 11,047,544 B2
(45) Date of Patent: Jun. 29, 2021

(54) LASER BASED ILLUMINATION DEVICE, AND VEHICLE HEADLAMP WITH SUCH LASER BASED ILLUMINATION DEVICE

(71) Applicant: Lumileds LLC, San Jose, CA (US)

(72) Inventor: Steffen Zozgornik, Leverkusen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/712,244

(22) Filed: Dec. 12, 2019

(65) Prior Publication Data

US 2020/0191352 A1 Jun. 18, 2020

(30) Foreign Application Priority Data

Dec. 17, 2018 (EP) ..... 18212986

(51) Int. Cl.

| | |
|---|---|
| ***F21S 41/33*** | (2018.01) |
| ***F21S 41/176*** | (2018.01) |
| ***F21S 41/16*** | (2018.01) |
| ***F21W 102/14*** | (2018.01) |

(52) U.S. Cl.

CPC ..... *F21S 41/337* (2018.01); *F21S 41/16* (2018.01); *F21S 41/176* (2018.01); *F21W 2102/14* (2018.01)

(58) Field of Classification Search

CPC ..... F21S 41/337; F21S 41/176; F21S 41/16; F21W 2102/14

See application file for complete search history.

(56) References Cited

FOREIGN PATENT DOCUMENTS

| | | | |
|---|---|---|---|
| DE | 102010028949 A1 | 11/2011 | |
| DE | 102015212758 | 12/2016 | |
| DE | 102015212758 B3 * | 12/2016 | ..... F21S 41/663 |

(Continued)

OTHER PUBLICATIONS

EP Application No. 18212986.6, "Extended EP Search Report," dated Jul. 8, 2019, 7 pages.

(Continued)

*Primary Examiner* — Mary Ellen Bowman

(57) ABSTRACT

An illumination device comprises at least a laser (1) emitting a laser beam (6) of light of a first wavelength, a wavelength converting member (5) converting at least part of the light of the first wavelength into light of a second wavelength, a scanning unit (4) adapted to scan the laser beam (6) across the wavelength converting member (5) and an imaging optics (2) imaging a light emitting face of the laser (1) via the scanning unit (4) onto the wavelength converting member (5). In the proposed device, the laser beam (6) is guided via reflection at a reflective member (3) to the wavelength converting member (5). The reflective member (3) comprises a combination of at least a first and a second reflective element (8, 9), wherein the first and second reflective elements (8, 9) are formed and arranged such that the light emitting face of the laser (1) is imaged as a mirror-inverted image on the wavelength converting member (5) via the first reflective element (8) and as a non-mirror-inverted image via the second reflective element (9), both images being superimposed on the wavelength converting member (5). Due to this reflective member, intensity fluctuations in the image of the light emitting face on the wavelength converting member are reduced without enlarging the image.

14 Claims, 3 Drawing Sheets

(56) References Cited

FOREIGN PATENT DOCUMENTS

| | | | | | |
|---|---|---|---|---|---|
| EP | 2581648 | A1 * | 4/2013 | ..... | F21S 41/675 |
| EP | 2581648 | A1 | 4/2013 | | |
| FR | 3006746 | A1 * | 12/2014 | ..... | B60Q 1/1423 |
| WO | 2016061599 | A1 | 4/2016 | | |
| WO | WO-2016061599 | A1 * | 4/2016 | ..... | B60Q 1/06 |
| WO | 2016149717 | A1 | 9/2016 | | |
| WO | WO-2016149717 | A1 * | 9/2016 | ..... | F21S 41/16 |
| WO | 2017164327 | A1 | 9/2017 | | |
| WO | WO-2017164327 | A1 * | 9/2017 | ..... | F21S 41/25 |

OTHER PUBLICATIONS

From the EPO as the ISA, Notification of Transmittal of the International Search Report and the Written Opinion corresponding to PCT/EP2019/083859 dated Mar. 9, 2020, 12 pages.

* cited by examiner

LASER BASED ILLUMINATION DEVICE, AND VEHICLE HEADLAMP WITH SUCH LASER BASED ILLUMINATION DEVICE

CROSS REFERENCE TO RELATED APPLICATIONS

This application claims priority to European Patent Application No. 18212986.6 filed on Dec. 17, 2018, and titled "LASER BASED ILLUMINATION DEVICE, AND VEHICLE HEADLAMP WITH SUCH LASER BASED ILLUMINATION DEVICE," which is incorporated herein by reference.

FIELD OF THE INVENTION

The present invention relates to a laser based illumination device at least comprising a laser emitting light of a first wavelength or wavelength range, a wavelength converting member converting at least part of the light of the first wavelength or wavelength range into light of a second wavelength or wavelength range, a scanning unit adapted to scan a laser beam of said laser across the wavelength converting member in order to generate an illumination pattern formed at least of the light of the second wavelength or wavelength range, and an imaging optics imaging a light emitting face of the laser via said scanning unit onto the wavelength converting member. The invention also relates to a reflecting member applicable in said illumination device and to a method of imaging an emitting face of a laser to an imaging plane, said method being used in said illumination device. Further, the invention relates to a vehicle headlamp with an inventive laser based illumination device.

Such a headlamp can be used as an adaptive headlamp of a vehicle to dynamically adapt the illumination of the road dependent on the situation.

BACKGROUND OF THE INVENTION

Adaptive headlamps are increasingly used in the automotive sector due to their clear benefits. These headlights are able to dynamically change or adapt the light distribution in front of the vehicle, in particular in the far field, such that a best possible illumination is provided without affecting other road users. If for example an oncoming car appears, the adaptive headlamp may generate a dark section at a position of the car while still maintaining full illumination of the rest of the road.

In order to achieve such a dynamically changing illumination adaptive headlamps provide one or several lasers scanning a wavelength converting member which converts the wavelength of the laser light to a wavelength range suitable for the desired illumination. Typically, a combination of the original wavelength or wavelength range of the laser light and the generated second wavelength range results in a bright white light which is used for illumination of the road. It is also possible to generate the white light directly by the conversion. By appropriately controlling the scanning of the laser beam across the wavelength converting member different illumination patterns can be generated. These illumination patterns are then imaged by an appropriate imaging optics to the far field. An example for such an adaptive headlamp is described in DE 102010028949 A1.

Typically, the scanning of the wavelength converting member is performed by imaging the emission face of the laser, in particular a laser diode, via the scanning unit onto the converter in order to achieve a minimum size of the laser spot that is scanned over the converter. The small spot size is necessary in order to achieve a sharply bounded illumination pattern in the far field. Typically used laser diodes comprise an elongated emitting face, the image of which is scanned over the converter in a direction perpendicular to its longitudinal axis. Due to near field intensity fluctuations based on the multimode characteristics of high power laser diodes, an intensity variation occurs along the longitudinal extension of the imaged emitting face. Such intensity variations may occur on a timescale of several seconds or minutes causing a stripe pattern when the laser spot is scanning over the converter. A homogenization of the intensity variation using appropriate homogenizers in the beam path is possible but leads to an undesired enlargement of the laser spot.

SUMMARY OF THE INVENTION

It is an object of the present invention to provide an illumination device, and an adaptive headlamp for a vehicle with such illumination device, in which the intensity variations in the laser spot scanning over the converter are reduced without enlarging the laser spot.

The proposed illumination device at least comprises at least one laser emitting a laser beam of light of a first wavelength or wavelength range, a wavelength converting member, also called converter, a scanning unit and an imaging optics imaging a light emitting face of the at least one laser via the scanning unit onto the wavelength converting member. The wavelength converting member is designed to convert at least part of the light of the first wavelength or wavelength range into light of a second wavelength or wavelength range. The scanning unit is adapted to scan the laser beam across the wavelength converting member to generate an illumination pattern formed at least of the light of the second wavelength or wavelength range. In the proposed illumination device, the laser beam is guided via reflection at a reflective member to the wavelength converting member. The reflective member comprises a combination of at least a first and a second reflective element. The first and second reflective elements are formed and arranged such that the light emitting face of said at least one laser is imaged as a mirror-inverted image on the wavelength converting member via the first reflective element and as a non-mirror-inverted image via the second reflective element, both images being superimposed on the wavelength converting member. This may be achieved for example by forming the reflective area of the reflective member of a combination of at least one mirror face as the first reflective element and at least one prismatic structure using two reflective faces for reflection as the second reflective element. The prismatic structure thus forms a retroreflective element in one dimension, e.g. in the x- or in the y-direction with respect to a x- and y-extension of the reflective area. The first and second reflective elements are arranged side by side such that both elements contribute to the reflection of the laser beam.

The illumination device may also comprise a second imaging optics adapted to image the illumination pattern formed on the converter to the far field.

With the proposed device and underlying method, an image of the emitting face is superimposed on the converter with a mirrored image of the emitting face. In the resulting image, thus, intensity variations over the emitting face are reduced compared to a simple image of the emitting face. The proposed device thus achieves a reduction of the intensity variations without enlarging the spot size of the laser spot (formed by the imaged emitting face) which is scanned over the wavelength converting member by the scanning unit.

The reduction of such intensity variations or fluctuations is further improved by using a plurality of said first and second reflecting elements on the reflecting area of the reflective member such that several of said first and second elements contribute to the reflection of the laser beam. Preferably, the first and second reflective elements are dimensioned such that at least ten of each of said elements contribute to the reflection of the laser beam. The first and second elements are preferably arranged such that first and second reflecting elements alternate along one direction on the reflective area of the reflecting member.

In a preferred embodiment, the prismatic structure comprises two reflective faces oriented at an angle of 90° to one another similar to the situation in a rectangular prism, i.e. a prism having a right-angled triangle as the base.

The reflective member of such an illumination device may be formed of a glass or polymer substrate in which at a distance from one another appropriate prismatic structures are formed. The surface of this substrate between the prismatic structures forms mirror faces (first reflective elements) and may to this end for example be coated with a reflective layer. An appropriate reflective coating may also be applied to the side faces of the prismatic structure if necessary to achieve the desired degree of reflection. Such a reflective member may for example be molded or cast. Another technique is to form the prismatic structures in the surface of the substrate by an etching technique or by laser ablation.

In another embodiment, the reflective member may be formed of a triangular 90° prism, wherein the inner surface of the hypotenuse of this prism serves as a mirror face due to total internal reflection. Appropriate prismatic structures are formed at a distance from one another at this hypotenuse, e.g. by forming out these structures from the hypotenuse by etching or laser ablation or by attaching such structures to the outer surface of the hypotenuse. The inner surface of the hypotenuse between the prismatic structures then forms the mirror faces (first reflective elements).

The reflective member is preferably arranged in the beam path between the laser and the scanning unit. Nevertheless, it may also be possible to use a scanning unit having a scanning mirror which is designed as the reflective member.

The laser is preferably formed of a laser diode or of a stack or bar of laser diodes. The wavelength converting member may be a reflective or a transmissive member, and may be formed for example of a ceramic plate of Cerium doped Yttrium-Aluminum-Garnet (YAG). The scanning unit may be formed of a biaxial movable mirror, for example a MEMS mirror.

The proposed illumination device is preferably used within a laser based high resolution adaptive headlamp in the automotive sector but can also be used for other applications requiring a similar adaptive illumination behavior. The same applies to the reflective member and the proposed method, which may also be used for other applications of laser imaging.

BRIEF DESCRIPTION OF THE DRAWINGS

The present invention is described in the following by way of examples in connection with the accompanying figures. The figures show.

DESCRIPTION OF EMBODIMENTS

Figure 1:
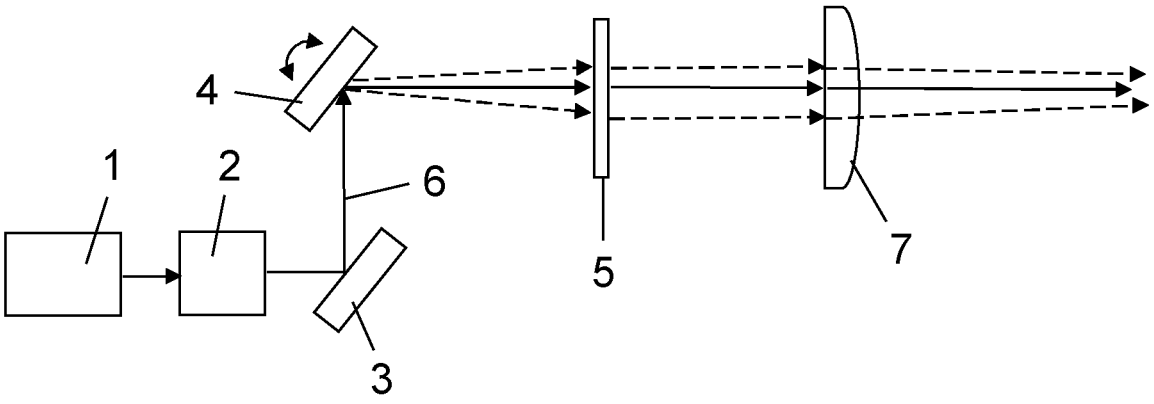
FIG. 1 a schematic sketch of an example of the proposed illumination device.

The proposed illumination device comprises at least one laser, a laser scanning unit, a wavelength converting member, imaging optics and a reflecting member. FIG. 1 shows an exemplary example of such an illumination device which can be used within an adaptive headlamp of a vehicle. The figure shows the laser 1 emitting a laser beam 6 in the blue wavelength range. The laser beam 6 is directed to a scanner 4, which scans the laser beam 6 across a wavelength converting member 5 to generate an illumination pattern of converted light in the yellow wavelength range. The scanning unit 4 is controlled by a control unit to scan the converting layer of the wavelength converting member 5 with a laser spot to generate the desired pattern. The illumination pattern is then projected with a second imaging optics 7 to the far field. The wavelength converting member 5 in this example is formed of an optically transparent ceramic plate containing a wavelength converting material like phosphor. The laser spot scanned over the wavelength converting member 5 is formed by an imaging optics 2 which images the emitting face of the laser 1 via the scanning unit 4 to the wavelength converting member 5. In the present invention the laser beam 6 emitted by the laser 1 is guided by reflection at a reflecting member 3 via the scanning unit 4 to the wavelength converting member 5. This reflective member 3 can be identified in FIG. 1. According to the present invention, this reflective member 3 has a special design of its reflective area such that the reflective area generates a mirror-inverted image and a non-mirror-inverted image exactly superimposed on the wavelength converting member 5.

Figure 2:
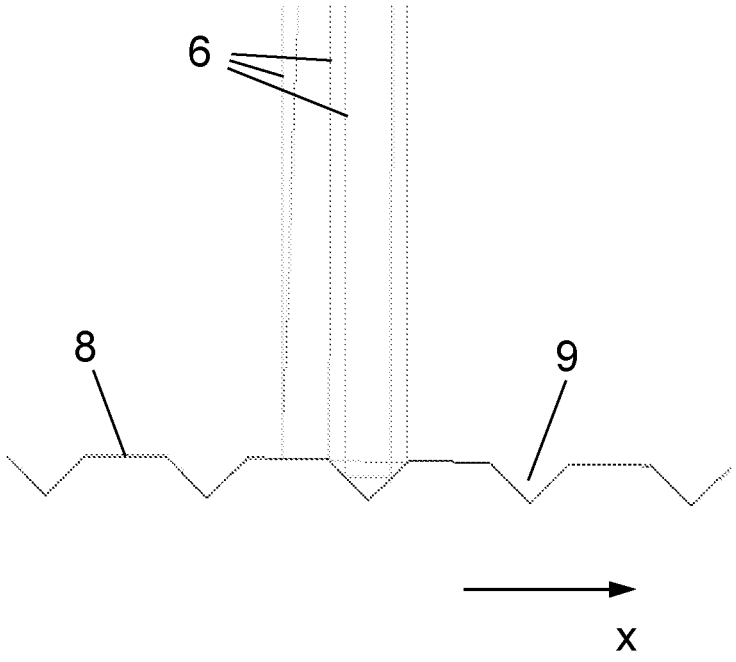
FIG. 2 a cross-sectional view of an exemplary design of the reflective member according to the invention.

FIG. 2 shows an exemplary design of such a reflecting member 3. The figure shows a cross-sectional view through a portion of the reflective area of the reflective member 3. As can be seen from FIG. 2, in this cross-sectional view, flat mirror areas 8 alternate with prismatic structures 9 in the reflective area. The prismatic structures 9 comprise two reflecting faces oriented perpendicular to one another similar to the situation in a rectangular prism. Therefore, two different imaging paths are combined with such a reflecting member. Using the imaging path through the 90° prism structure instead of that of the flat mirror the image is mirrored along the axis of the top edge of the prism. This results in a non-mirror-inverted image. The reflection on the flat mirror, on the other hand, results in a mirror-inverted image. With such a reflective member 3, thus, two images are created—one is mirrored, one is not—and superimposed on the same spot on the wavelength converting member 5. If the intensity fluctuation is not strictly symmetric it will be reduced with this effect. The remaining fluctuation then will be strictly symmetric after reflection at the reflecting element 3. Preferably, instead of one prism an array of small prisms or prismatic structures 9 with flat mirror areas 8 in-between are used to achieve the same effect. The figure also shows three exemplary reflecting paths of the laser beam 6, one reflecting at the flat mirror area 8 and the other two reflecting at the prismatic structure 9. From this perspective, the reflective member 3, due to the prismatic structures 9, has a retroreflective behavior such that the member 3, with respect to the dimension visible in this perspective, should be oriented perpendicular or nearly perpendicular to the impinging laser beam 6.

Figure 3:
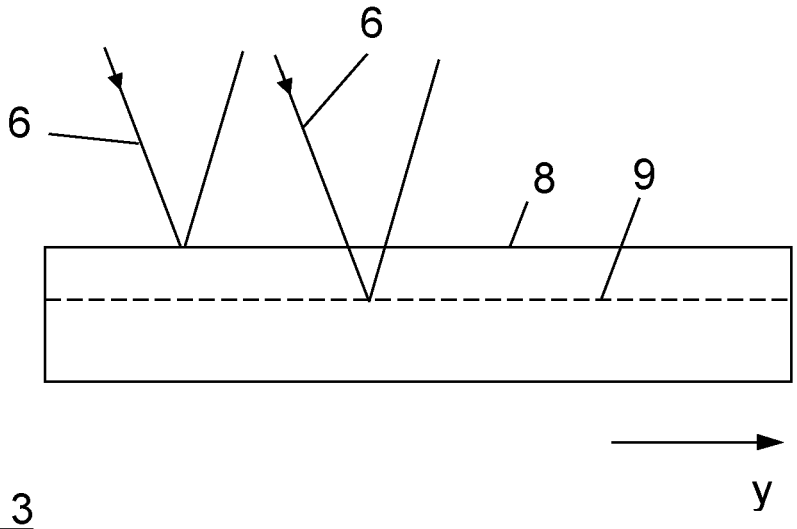
FIG. 3 a cross-sectional view of the reflective member of FIG. 2 in a plane perpendicular to the cross-sectional plane of FIG. 2.

FIG. 3 shows a cross-sectional view of this reflecting member 3 in a cross-sectional plane perpendicular to the plane of FIG. 2. As can be seen from this figure, the reflection in the dimension visible in such perpendicular perspective is not retroreflective so that the reflecting member 3 may be arranged within the laser beam as indicated for example in FIG. 1.

Figure 4:
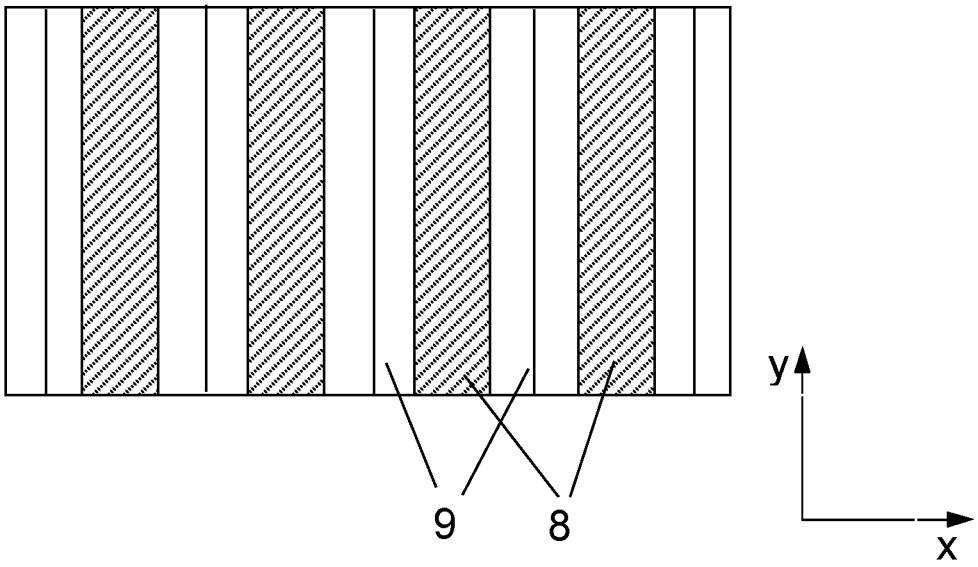
FIG. 4 a plan view on the reflective member of FIGS. 2 and 3.

FIG. 4 shows a plan view of the reflective member 3 of FIGS. 2 and 3 in which the alternating prismatic structures 9 and flat mirror areas 8 can be clearly recognized.

Figure 5:
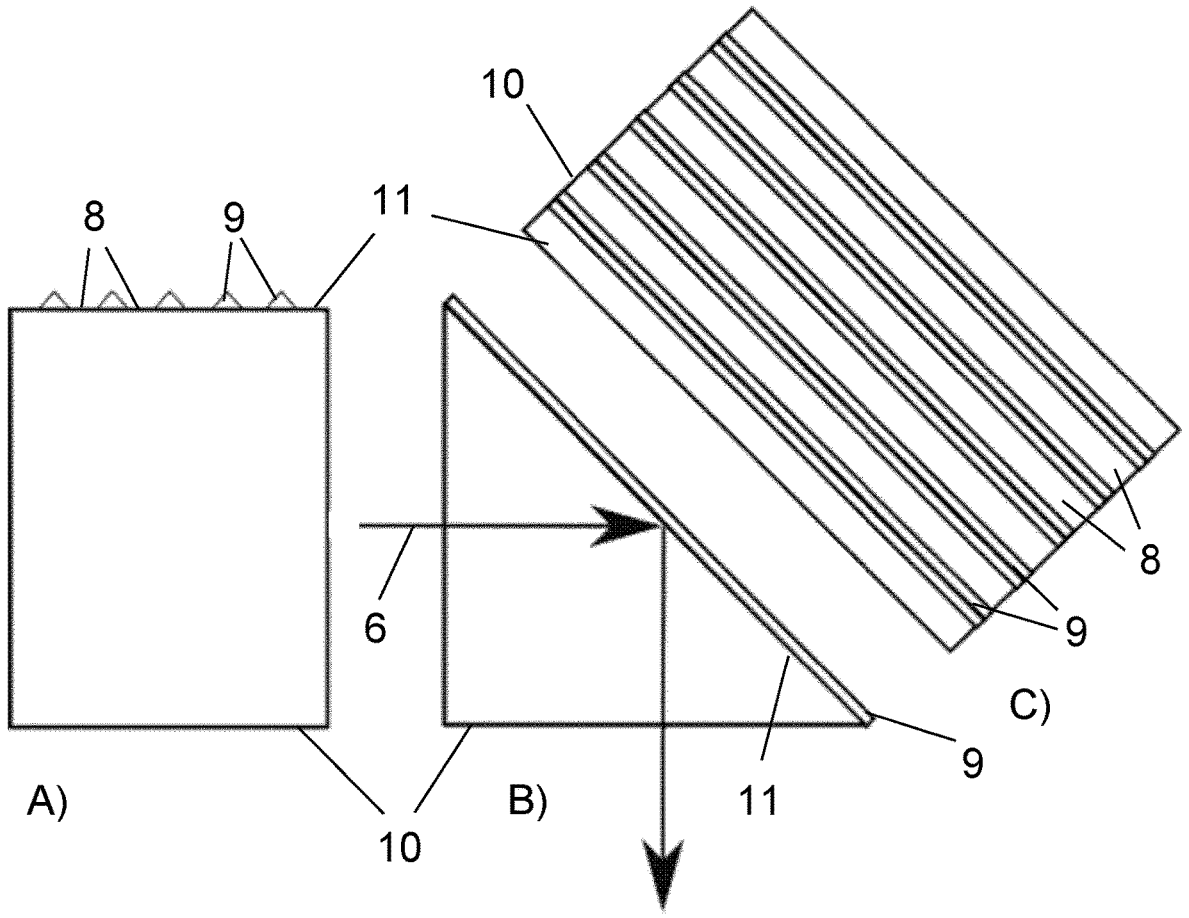
FIG. 5 a further exemplary design of the reflective member according to the invention in three different views

FIG. 5 shows, in three different views, a further exemplary design of a reflecting member according to the invention. In this example, the reflecting member is formed of a triangular 90° prism 10. The inner surface of the hypotenuse 11 of this prism 10 serves as a reflecting face. The incoming laser beam 6 is reflected at this surface by internal total reflection as schematically shown in FIG. 3B). By forming out or applying prismatic structures—as already described with FIGS. 2 to 4—of or to the hypotenuse 11, a structure of alternating prismatic structures 9 and flat mirror areas 8 (areas of internal reflection) is achieved. FIG. 3C) is a plan view on the hypotenuse 11 of the prism 10 from which this structure can be recognized. FIG. 3A) shows a side view in which only the prismatic structures 9 are visible at the hypotenuse 11.

For the application of the illumination device within an adaptive headlamp in the automotive sector, laser diodes having emitter faces with typical dimensions in the range of 30 to 40 micrometers can be used. The image of these emitter faces on the converter element is typically approximately ten times enlarged, i.e., has dimensions of several 100 micrometers. The imaging optics has a diameter of typically 3 to 4 mm, the reflective area of the reflecting member then comprises several $mm^2$. On this reflective area, preferably, between 10 and 100 first and second reflective elements are arranged side by side. This is only an example of dimensioning such an illumination device. Depending on the application and desired reduction of intensity fluctuations, also completely other dimensions and numbers of first and second reflecting elements may be used.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the invention.

LIST OF REFERENCE SIGNS

1 Laser
2 Imaging optics
3 Reflective member
4 Scanning unit
5 Wavelength converting member
6 Laser beam
7 Second imaging optics
8 Flat mirror area
9 Prismatic structure
10 Triangular 90° prism
11 Hypotenuse

The invention claimed is:

1. An illumination device, comprising:

at least one laser emitting a first laser beam light of a first wavelength or wavelength range, a wavelength converting member converting at least part of the first laser beam light into a second light of a second wavelength or wavelength range, a scanning unit adapted to scan the first laser beam across the wavelength converting member in order to generate an illumination pattern formed at least of the second light, an imaging optics adapted to form a laser spot to be scanned by the scanning unit onto the wavelength converting member by imaging a light emitting face of the at least one laser, and a reflective member adapted to guide via reflection the first laser beam to the wavelength converting member, said reflective member comprising a combination of at least a first and a second reflective element, said first and second reflective elements formed and arranged such that the light emitting face of said at least one laser is imaged as a mirror-inverted image on the wavelength converting member via the first reflective element and as a non-mirror-inverted image via the second reflective element, both images being superimposed on the wavelength converting member.

2. The illumination device according to claim 1, wherein said reflective member comprises a combination of at least one flat mirror face as said first reflective element and at least one prismatic structure using two reflective faces for reflection as the second reflective element, said first and second reflective elements being arranged side by side.

3. The illumination device according to claim 2, wherein said reflective member is formed of a triangular 90° prism, said at least one flat mirror face being formed by an inner surface of a hypotenuse of the prism and said at least one prismatic structure being attached to or formed out of an outer surface of the hypotenuse of the prism.

4. The illumination device according to claim 2, wherein said two reflective faces of said prismatic structure are oriented at an angle of 90° to one another.

5. The illumination device according to claim 1, wherein said reflective member is formed of a plurality of said first and second reflecting elements, such that several of said first and second reflecting elements contribute to the reflection of the first laser beam.

6. The illumination device according to claim 1, wherein said device comprises a second imaging optics imaging said illumination pattern to the far field.

7. The illumination device according to claim 1, wherein said reflective member is arranged between the laser and the scanning unit.

8. The illumination device according to claim 1, wherein said reflective member is part of the scanning unit.

9. The illumination device according to claim 1, wherein said laser is formed of a laser diode or of a stack or bar of laser diodes.

10. The illumination device according to claim 1, wherein said reflective member comprises a combination of at least one flat mirror face as a first reflective element and at least one prismatic structure using two reflective faces for reflection as a second reflective element, said first and second reflective elements being arranged side by side.

11. The illumination device according to claim 10, wherein said reflective member is formed of a triangular 90° prism, said at least one flat mirror face being formed by an inner surface of a hypotenuse of the prism and said at least one prismatic structure being attached to or formed out of an outer surface of the hypotenuse of the prism.

12. The illumination device according to claim 10, wherein said two reflective faces of said prismatic structure are oriented at an angle of 90° to one another.

13. The illumination device according to claim 10, wherein said reflective member comprises a plurality of said first and second reflecting elements side by side.

14. A headlamp for a vehicle, comprising an illumination device according to claim 1.

* * * * *